United States Patent [19]

Russell et al.

[11] Patent Number: 4,890,188

[45] Date of Patent: Dec. 26, 1989

[54] SOLENOID DRIVER SYSTEM

[75] Inventors: Gary Russell, Pacific Grove; Walter J. Kozacky, San Jose, both of Calif.

[73] Assignee: Lockwood Technical, Inc., Sand City, Calif.

[21] Appl. No.: 252,980

[22] Filed: Oct. 4, 1988

[51] Int. Cl.[4] ..... H01H 47/22; H01H 47/32

[52] U.S. Cl. ..... 361/154; 361/153; 361/194; 361/203; 361/93; 340/664; 307/82

[58] Field of Search ..... 361/152, 153, 154, 194, 361/203, 93; 222/631, 634; 340/664; 123/490; 307/82, 43

[56] References Cited

U.S. PATENT DOCUMENTS

| | | | |
|---|---|---|---|
| 3,864,608 | 2/1975 | Normile et al. | 361/154 |
| 4,173,030 | 10/1979 | Rabe | 361/154 |
| 4,438,478 | 3/1984 | Matsuyama | 361/152 |
| 4,470,095 | 9/1984 | Dönig | 361/153 |
| 4,630,165 | 12/1986 | D'Onofrio | 361/154 |

*Primary Examiner*—A. D. Pellinen
*Assistant Examiner*—David Osborn
*Attorney, Agent, or Firm*—Hugh D. Jaeger

[57] ABSTRACT

A solenoid driver system drives a solenoid, such as a solenoid in a glue applicator or any like apparatus incorporating a solenoid, and which requires control of the solenoid in response to a signal voltage. The solenoid driver system generates a turn on signal that enables the solenoid, such as that of a glue gun applicator, to energize quickly because of a rapid rise solenoid signal. A solenoid driver stage of two switching transistors and two high voltage fast recovery diodes are connected to a control pulse through a high side optical isolator and a high side buffer, and a low side optical isolator and a low side buffer. The low side circuit includes a trigger circuit and a delay circuit connected to a gate along with a free-running oscillator for periodically energizing the low side drive of the circuit in a mode as long as the input signal is energized. This ensures that the amount of current dissipated in the solenoid coil is small. A current sensing fault logic and shut down logic are provided to prevent damage to the solenoid driver system circuitry or the solenoid coil.

20 Claims, 11 Drawing Sheets

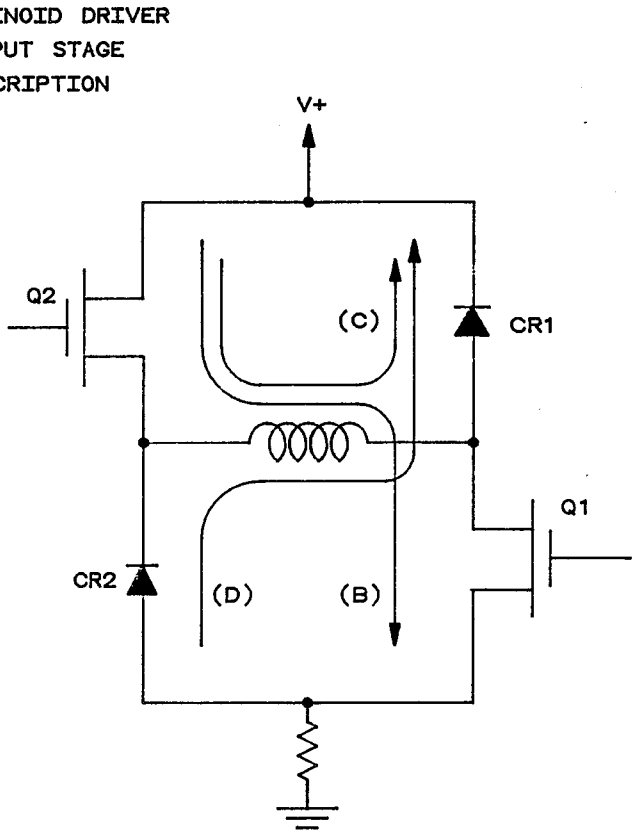

SOLENOID DRIVER
OUTPUT STAGE
DESCRIPTION (A) NO CURRENT FLOWS (SOLENOID IS OFF). Q1 AND Q2 OFF.

(B) MAXIMUM CURRENT FLOWS, SOLENOID BEING CHARGED BY FULL SUPPLY VOLTAGE (SOLENOID IS ON OR BEING TURNED ON). Q1 AND Q2 ON.

(C) SOLENOID CURRENT IS FREE-WHEELING VIA Q2 AND CR1 (SOLENOID IS ON). Q1 OFF AND Q2 ON.

(D) SOLENOID IS BEING DISCHARGED BY FULL SUPPLY VOLTAGE VIA CR1 AND CR2 (SOLENOID IS BEING TURNED OFF). Q2 AND Q1 OFF.

FIG. 5

SOLENOID DRIVER SYSTEM

BACKGROUND OF THE INVENTION

1. Field of the Invention

The present invention pertains to a solenoid driver system, and more specifically, a solenoid driver system for energizing a solenoid coil with a rapid rise output signal that energizes the solenoid coil for rapid turn on and reduces the time lag between a turn on signal and the actual energizing of the coil.

2. Description of the Prior Art

The prior art control of solenoids has been concerned with reducing solenoid power requirements while still providing an ample holding voltage for the solenoid. Prior art solenoids have utilized a dropping resistor across the solenoid coil which resulted in wasted power being converted into heat. Further, the driving signal was a decreasing signal of a waveform characterized as a downward curved ramped signal. The heat that the solenoid coil or coils would add to the surrounding environment was sometimes sufficient such as to raise the temperature in an existing environment.

Prior art did not appear to have recognized the requirement for rapid turn on of the solenoid coil with accuracy followed by minimum lower holding current, such as through pulse width variation thereby minimizing heat buildup and dissipation in the solenoid coil.

As multiple solenoids were added, the response and holding voltage degraded resulting in a slower opening and less adhesive pressure.

Representative prior art patents include U.S. Pat. No. 4,630,165, entitled "DC Power Control for DC Solenoid Actuators", and U.S. Pat. No. 3,864,608, entitled "Combination Mono Stable and A Stable Inductor Driver".

The particular application for the present invention is for a glue gun applicator, requiring accurate turn on of the solenoid. In the prior art devices, the solenoid control would tend to burn out the solenoids or the turn on time was not accurate. In the past, the glue gun was left on all of the time, or in the alternative, a pulse was used to turn on a solid state relay that was synchronized to the AC line. Based on a 60-cycle AC line and the point of the cycle, the inaccuracy of previous dispensing methods of solenoid control could be as much as 8 milliseconds between high and low peaks, depending on where the control pulse was applied in reference to the AC line which is completely asynchronous. This resulted in sporadic glue dispensing and solenoid control.

The present invention overcomes the disadvantages of the prior art by providing control of a solenoid with low power where the modulating circuit and the trigger circuit maintain the coil power to a reasonably low value, and there are no AC synchronization problems. This provides that the use of the solenoid coil becomes accurate and economical. When the present invention is applied to glue dispensing, accuracy is extremely enhanced in providing a consistent application of glue, and minimizing or eliminating waste of the glue.

SUMMARY OF THE INVENTION

The general purpose of the present invention is to provide a solenoid driver system which converts a 120 volt AC power supply to a fully rectified output signal, consisting of an initial turn on or pulse of a relatively high current followed by a relatively low holding current which is pulsed width controlled. The solenoid driving system is for a glue applicator, and can be used in any other type of an applicator requiring the switching of a solenoid coil. Teachings of this disclosure are applicable for any input control signal, line voltage, and the solenoid coil voltage, current and power requirements.

According to one embodiment of the present invention, there is provided a solenoid driver system including a power supply providing a driving power supply voltage, a high side logic voltage and a low side logic voltage. A control pulse connects to a high side optical isolator and a low side optical isolator. A high side buffer connects between a solenoid driver stage and the high side optical isolator. A trigger circuit and delay circuit connect to a low side optical isolator and to a gate. A free-running gate also connects to the gate. The gate connects to shut down logic, which connects to the low side buffer, and which connects to the solenoid driver stage. A current sensing fault logic connects between the solenoid driver stage and the shut down logic. The solenoid driver stage outputs an initial turn on current pulse followed by a free-running current width of the holding current pulse, and frequency of the holding current pulse is predetermined as the width of the initial turn on pulse.

Significant aspects and features of the present invention provide a solenoid driver system which provides an initial turn on current pulse of 3 milliseconds duration of a high DC voltage to energize a solenoid coil and then provides a holding current pulse of 3 milliseconds every 35 milliseconds for the remainder of the signal duration, by way of example, for purposes of illustration only, and not to be construed as limiting of the present invention. This signal provides minimal power dissipation in the solenoid, providing for long life of the solenoid coil and minimal heat dissipation.

Another significant aspect and feature of the present invention is a solenoid driver system which provides for accurate dispensing of glue from a glue applicator or glue gun.

A further significant aspect and feature of the present invention is a solenoid driver system which is not asynchronous to the AC power line. The solenoid driver system provides that a solenoid can operate in a low power mode because the modulating circuit and the trigger circuit maintains the coil power at a low value. This provides a more accurate and economical dispensing of glue, providing a glue stitch pattern which is consistent in application and eliminating waste of glue.

Having thus described the embodiments of the present invention, it is a principal object hereof to provide a solenoid driver system for driving a solenoid coil where accuracy of turn on is assured, as well as low power consumption in holding the solenoid coil in an energized state.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein:

FIG. 5 illustrates a mode of operation discussion of the solenoid driver transistor bridge; and, FIG. 6 illustrates a timing diagram for designated components.

DESCRIPTION OF THE PREFERRED EMBODIMENTS

Figure 1:
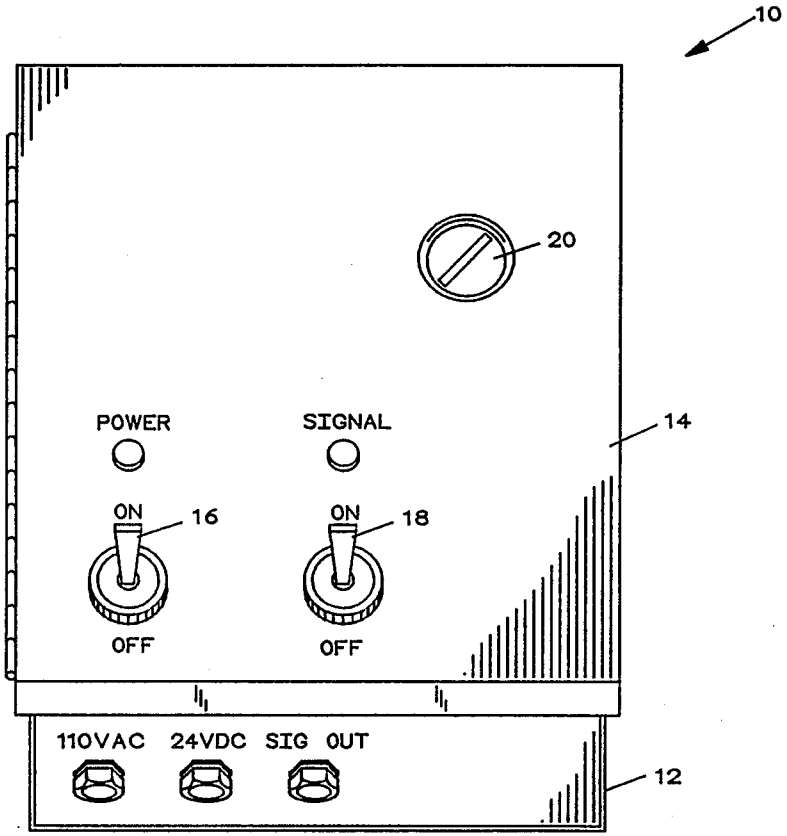
FIG. 1 illustrates a front perspective view of a solenoid driver system.

FIG. 1 illustrates a front perspective view of a solenoid driver system 10 including a housing 12 with a hinged door 14. A power switch 16, a signal switch 18, and a screw latch 20 position on the hinged door 14. A plurality of cable lock nuts, including 110 volts AC, 24 volts DC control signal in, and solenoid driver signal out mount on the bottom of the housing 12. In the alternative of using the screw latch 20, dual screw type lock downs can be utilized about the sides of the housing.

Figure 2:
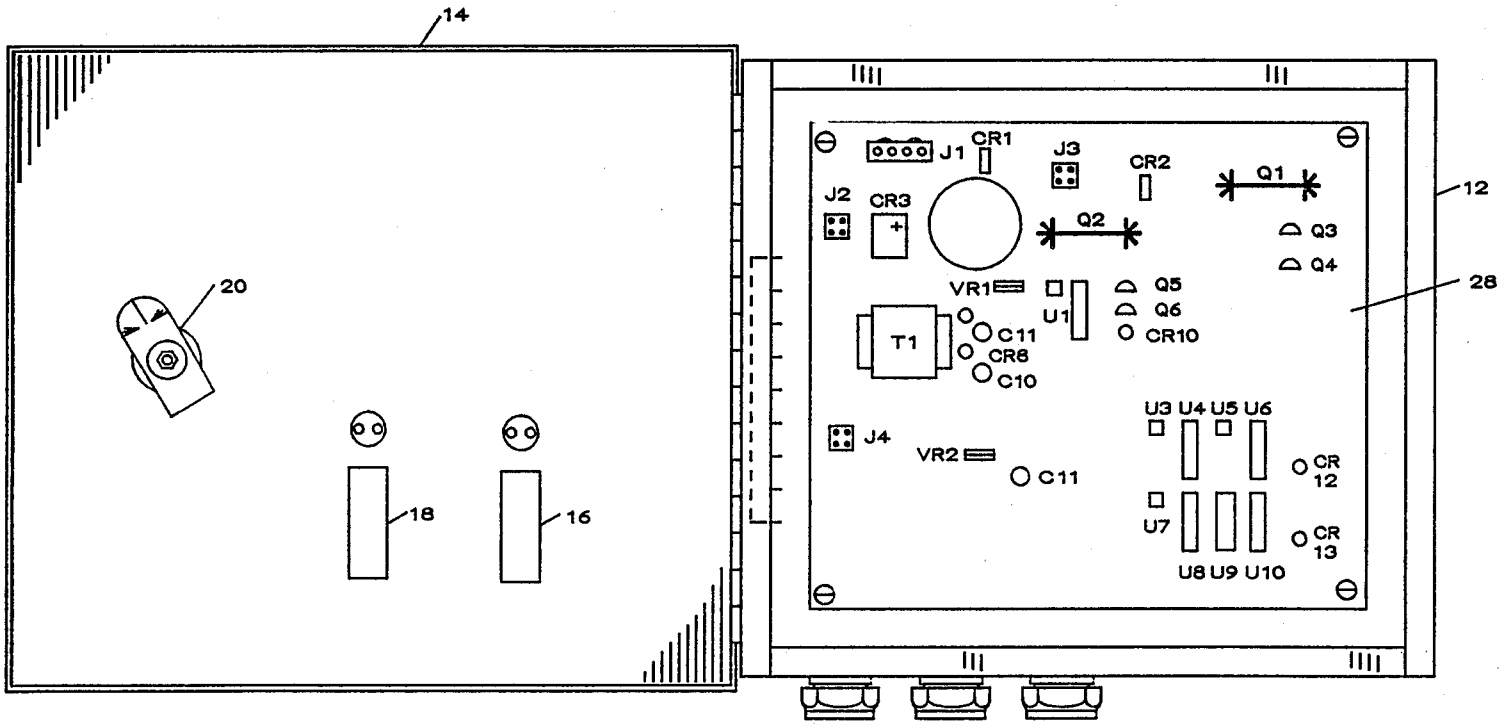
FIG. 2 illustrates a front view of the housing.

FIG. 2 illustrates a front view of the housing 12 with the hinged door 14 open, and illustrates a circuit board 28 with the major components mounted thereon as later described in detail, and as illustrated mounted on the circuit board 28.

Figure 3:
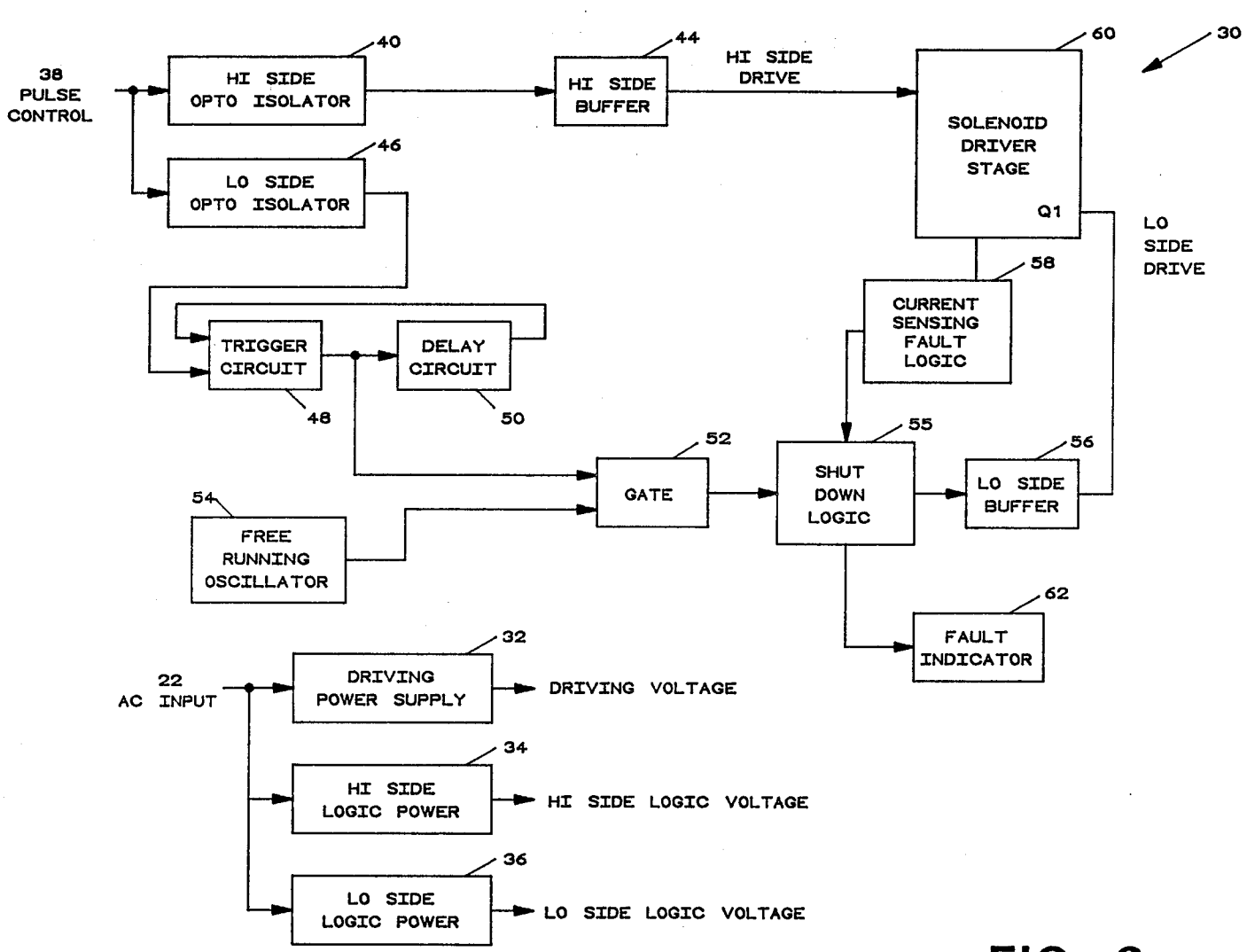
FIG. 3 illustrates an electrical circuit block diagram of the solenoid driver system.

FIG. 3 illustrates an electrical circuit block diagram 30 of the solenoid driver system 10. The AC input 22 is applied to connector J2 of FIG. 2, and is rectified by a rectifier bridge CR3. This is then filtered by a filter capacitor C1 of FIG. 4F which serves as the driving voltage for the solenoid through the driving power supply 32. Driving voltage is typically 160 to 170 volts DC. The AC input 22 also connects to a transformer T1 which has two separate primaries which generates two separate independent 12 volt DC supply voltages for a high side logic voltage 34 and a low side logic voltage 36.

A control pulse 38 is inputted at the connector J4 to a high side optical isolator 40 and a low side optical isolator 46. The high side optical isolator 40 connects to a high side buffer 44 and then to a transistor Q2 of FIG. 4. The low side optical isolator 46 connects to a trigger circuit 48 which then connects to a delay circuit 50 and a gate 52. A free-running oscillator 54 also connects to the gate 52. The gate 52 connects to a shut down logic 55, low side buffer 56, and then to a transistor Q1 of FIG. 4. A current sensing fault logic 58 connects between the solenoid driver stage 60 and the shut down logic 55. The shut down logic 55 connects to a fault indicator 62.

Figure 4A:
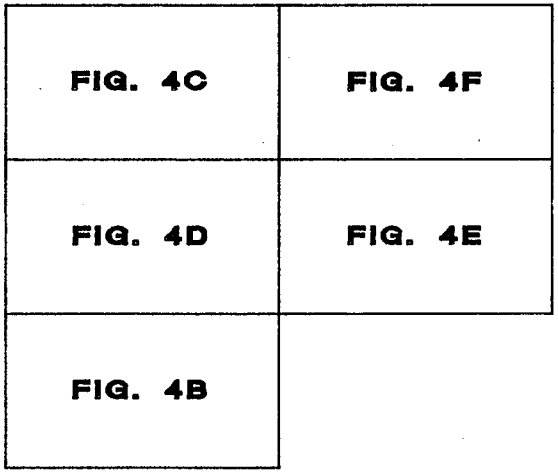
FIGS. 4A illustrates the layout of the electrical schematic diagrams, of FIGS. 4B–4F.

FIG. 4A illustrates the layout of the electric circuit schematic diagram of FIGS. 4B–4F. The drawing sheets 4B–4F of the schematic diagram are positioned with respect to each other, and the circuit lines connect, providing a complete electrical schematic circuit diagram for the solenoid driver system 10.

Figure 4B:
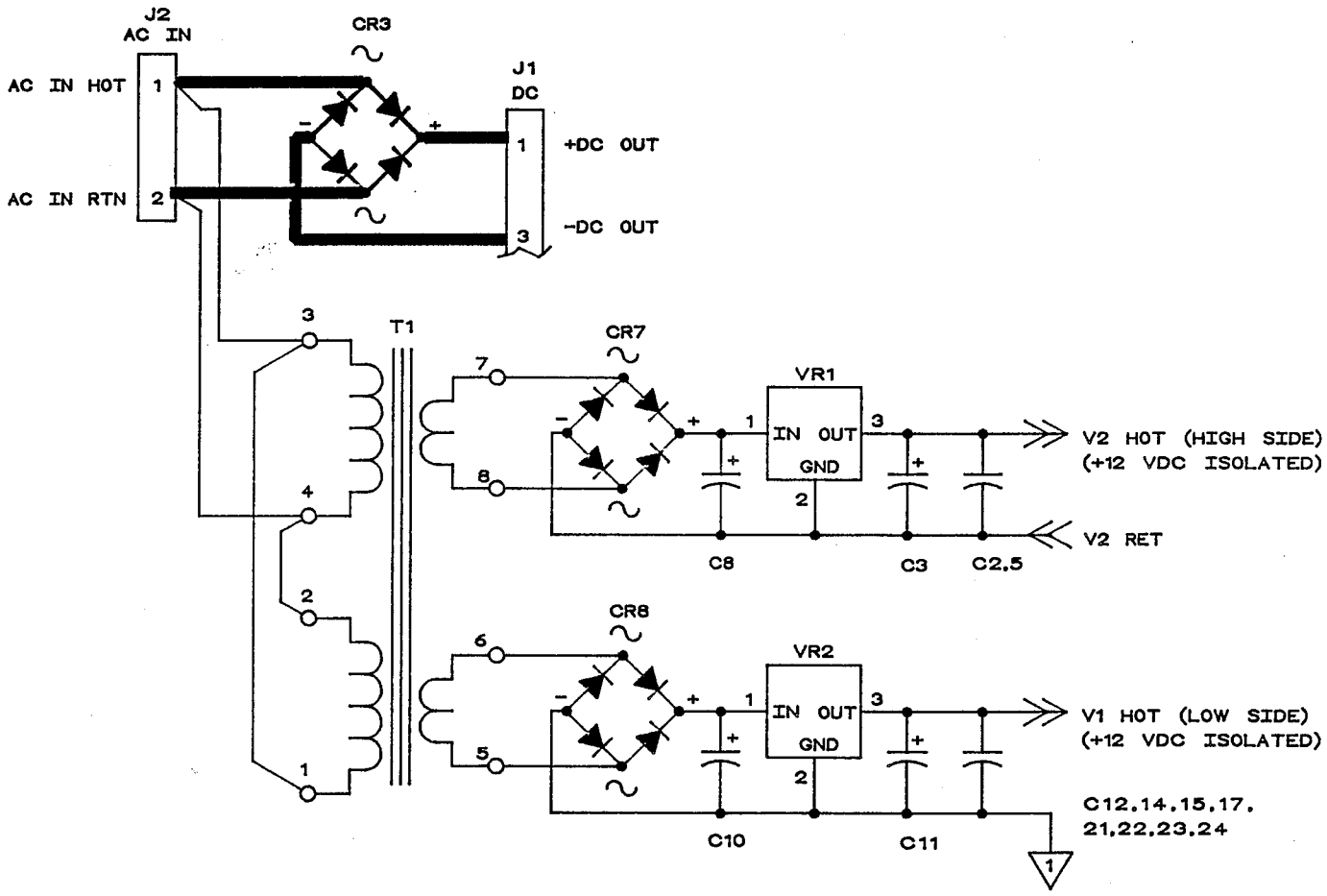
FIG. 4B–4F illustrate the electrical circuit of the solenoid driver system.

FIG. 4B illustrates a power supply connector J2 which is connected to the high voltage side as illustrated in heavy lines to connector J1 and which is rectified by bridge rectifier CR3 for the primary driving voltage for the solenoid. J2 also connects to the transformer T1. The voltage through transformer T1 generates two independent supplies of 12 volts utilizing bridge rectifiers CR7 and CR8, voltage regulators VR1 and VR2, and the respective filter capacitors. The two power supplies for the high side logic power and low side logic power isolate and serve to drive the two N channel field effect transistors Q1 and Q2 which switch the solenoid driver voltage. Capacitors C3, C8, C10 and C11 are filtering capacitors. Capacitors C2, C12, C14, C15, C17, C21, C22, C23 and C24 are bypass/decoupling capacitors.

Figure 4C:
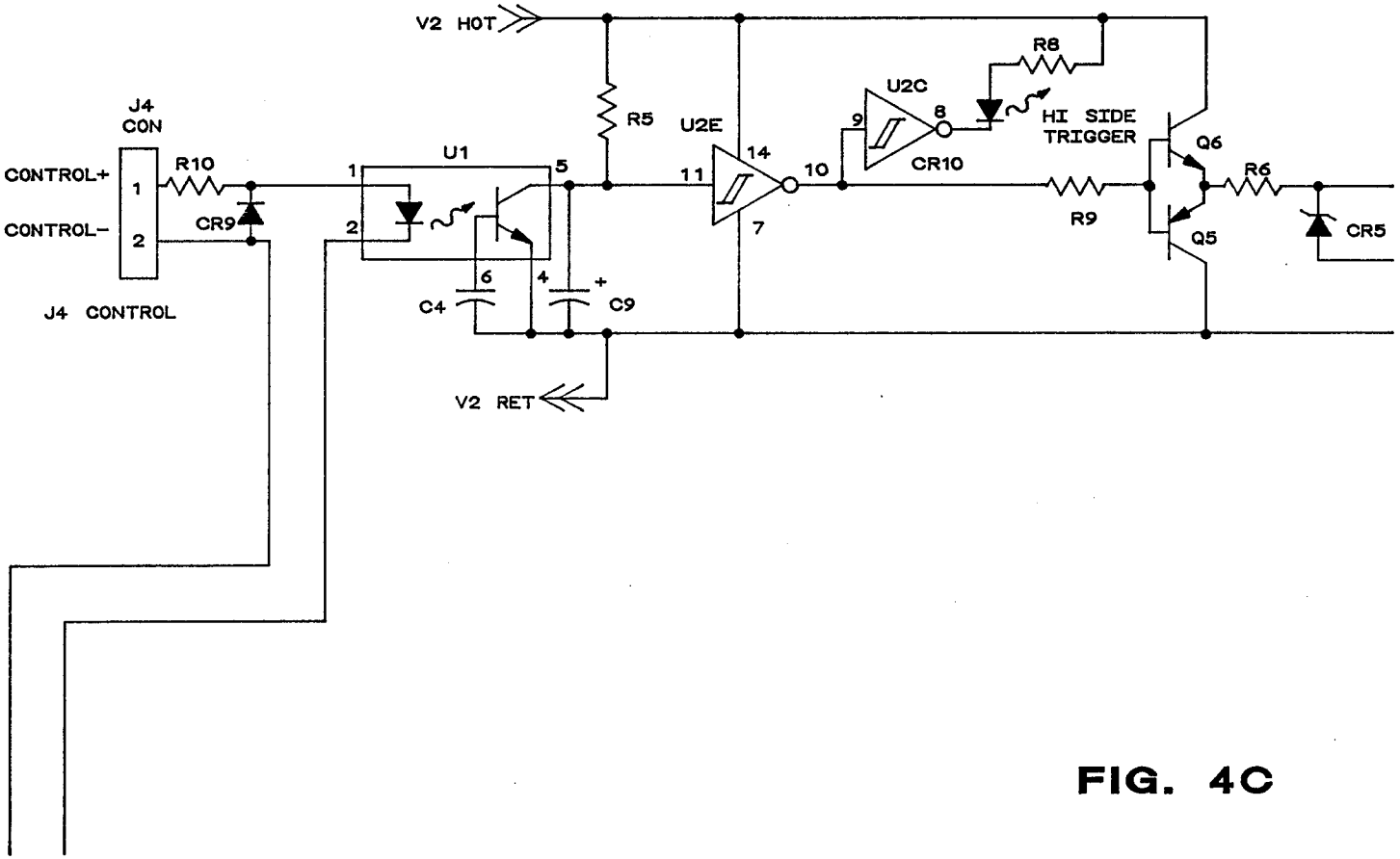
Figure 4D:
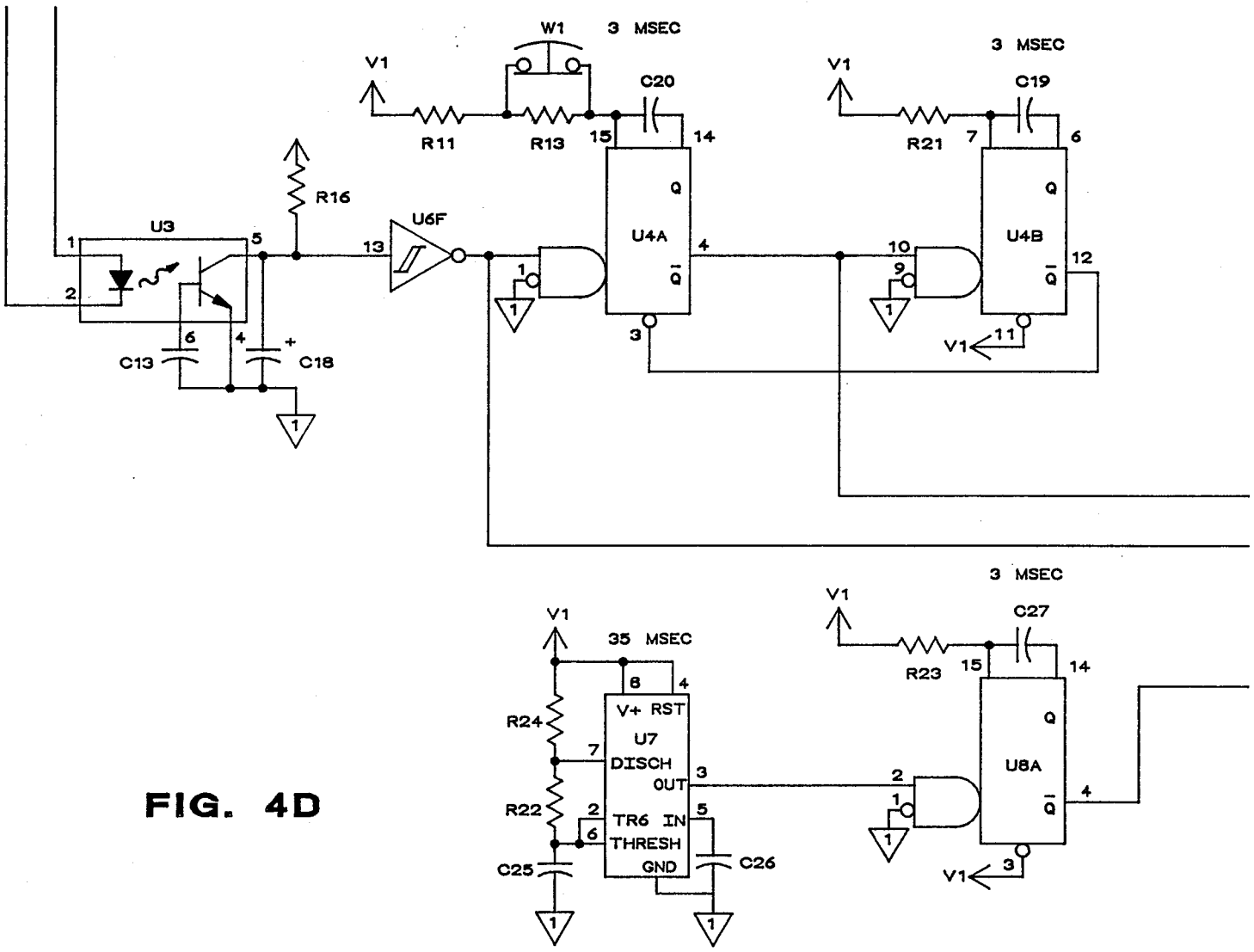

FIG. 4C illustrates an incoming control pulse signal through the connector J4 which is optically coupled through optical isolators U1 and U3 of FIG. 4D. The optical isolators U1 and U3 then generate two different independent pulses that are electrically isolated from each other. The top high side signal couples through the optical isolator U1 to the high side buffer, is Schmitt triggered by U2E, and then drives a complementary emitter follower stage (CEFS) of Q5 and Q6 which drives the gate of transistor Q2 of FIG. 4F. Q2 is the N channel FET in the upper part of the bridge of FIG. 4F.

The high side optical isolator 40 of FIG. 3 includes a current limiting resistor R10, a small signal diode CR9, an optical isolator U1, a bypass/decoupling capacitor C4, a bypass/decoupling capacitor C9, and a pull-up resistor R5.

The high side buffer 44 of FIG. 3 includes gates U2E, U2C, LED CR10, pull-up resistor R8, current limiting resistor R9, Q5–Q6 of the CEFS, and a zener diode CR5. Q1 and Q2 are high voltage N channel FETs. Q5 is a PNP small signal transistor. Q6 is a NPN small signal transistor.

FIG. 4D illustrates the other optically isolated low side signal coupled through the optical isolator U3 which then triggers Schmitt trigger U6F. U6F drives the gate of the lower N channel FET Q1 of FIG. 4F through gates U6F, U6C, U10A, U10C, U10B, U6A, and U6B and through the complementary emitter follower stage (CEFS) Q3 and Q4 which drives the gate of Q1 of FIG. 4F.

The low side optical isolator 46 of FIG. 3 and of FIG. 4D includes gates U3, a bypass/decoupling capacitor C13, a filter capacitor C18, and a pull-up resistor R16.

A trigger circuit 48 of FIG. 3 and of FIG. 4D includes a Schmitt trigger U6F, a dual monostable U4A, a timing capacitor C20, and timing resistors R11 and R13.

A delay circuit 50 of FIG. 3 and of FIG. 4D includes a dual monostable U4B, a timing capacitor C19, and a timing resistor R21.

A free-running oscillator 54 of FIG. 3 and of FIG. 4D includes multivibrator U7, a timing resistors R22 and R24, a timing capacitor C25, a bypass/decoupling capacitor C26, a dual monostable U8, a timing capacitor C27, and a timing resistor R23.

Figure 4E:
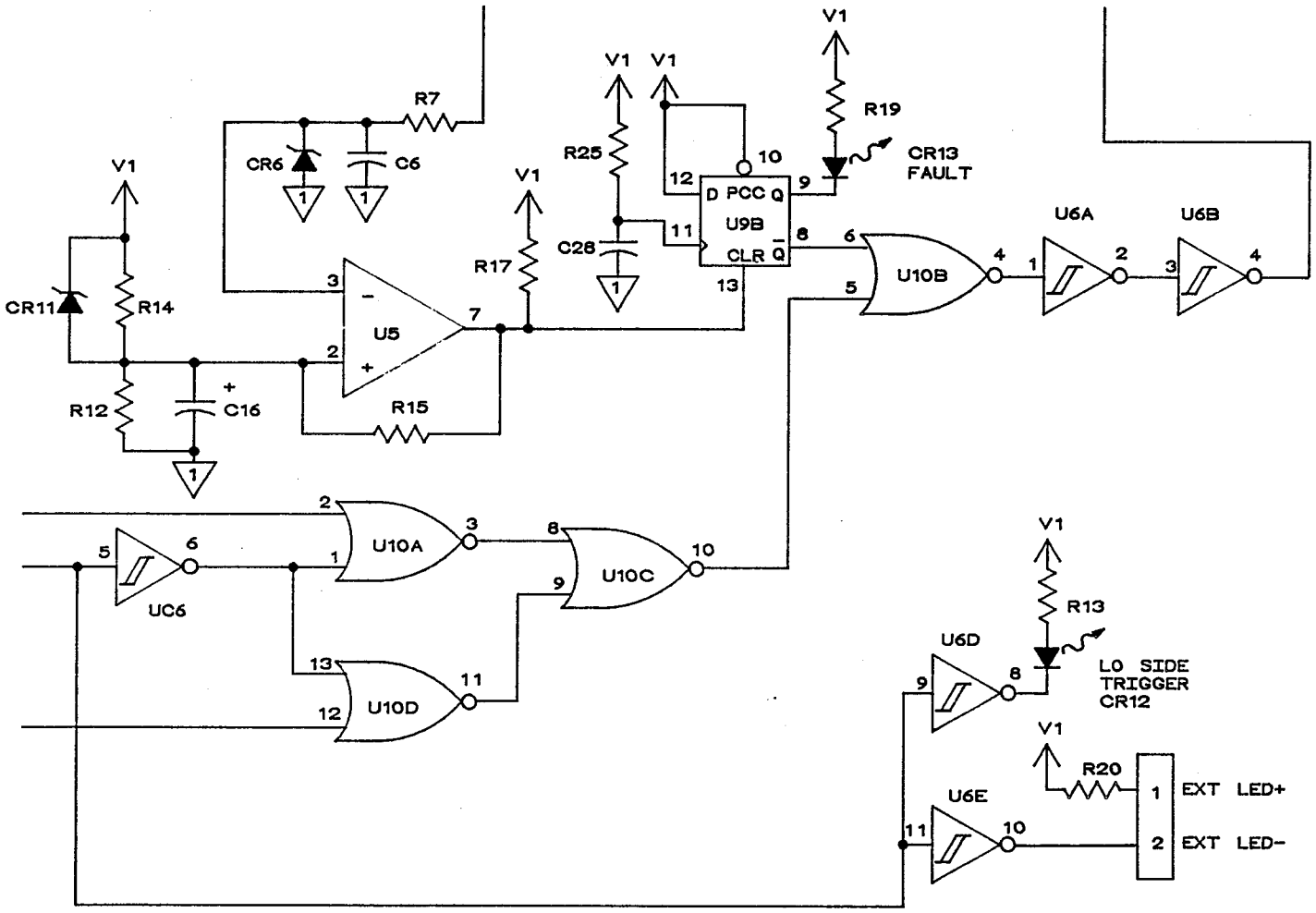

FIG. 4E illustrates the gate 52 of FIG. 3 including Schmitt trigger U6C, and quad nor gates U10A, U10B, U10C and U10D.

The low side buffer 56 of FIG. 3 includes U6D, LED CR12, pull-up resistor R18, Schmitt trigger U6E, current limiting resistor R20, and an external LED.

Figure 4F:
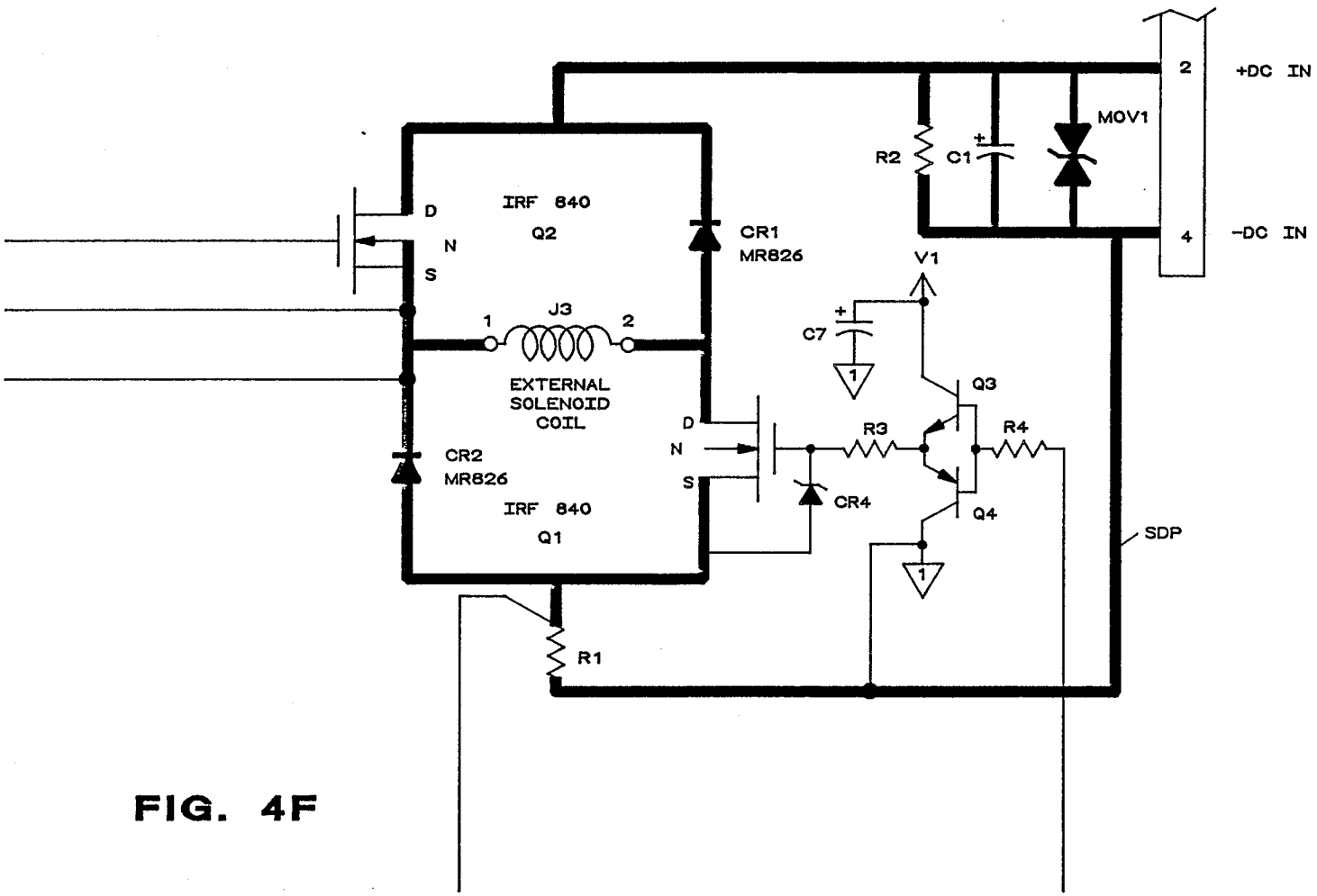

The low side buffer 56 also includes in FIG. 4F current limiting resistor R4, CEFS, Q3 and Q4, a current limiting resistor R3, a zener diode CR4, and a filter capacitor C7.

The current sensing fault logic 58 of FIG. 3 and of FIG. 4E includes comparator U5, voltage divider resistors R12, R14 and R15, small signal diode CR11, filter capacitor C16, pull-up resistor R17, current sensing resistor RI of FIG. 4F, current limiting resistor R7, filter capacitor C6, and zener diode CR6.

The shut down logic 54 of FIG. 3 and of FIG. 4E includes dual flip-flop U9B, timing resistor R25, timing capacitor C28, pull-up resistor R19, LED CR13, and quad nor gate U10B.

FIG. 4F illustrates the solenoid driver stage 60 of FIG. 3, and includes N channel FETs Q1 and Q2, fast recovery diodes CR1 and CR2, and the coil of the external solenoid.

FIG. 4F also includes the sensing resistor R1 for the current sensing fault logic and components of a voltage suppressor MOV 1, a filter capacitor C1, and a bleeder resistor R2.

The low side buffer includes a current limiting resistor R4, the CEFS Q3 and Q4, the current limiting resistor R3, the filter capacitor C7, and the zener diode CR4. The specific circuit carrying the solenoid driving power is illustrated in a heavy line designated SDP.

MODE OF OPERATION

A constant pulse input on the control signal J4 generates a pulse at U4. This pulse is typically 3 milliseconds by way of example and for purposes of illustration only, and is adjusted by selection of the capacitor C20 and the resistor R11. This is then gated by U10A, U10B, and U10C through the Schmitt trigger, and also drives the transistor Q1. The multi-vibrator U7 generates a pulse train about 3 milliseconds wide every 35 milliseconds, by way of example and for purposes of illustration only and not to be construed as limiting of the present invention. This is then gated by U10C and U10D to drive Q1. When the pulse train is applied to J4, the monostable U4A generates an initial pulse. This signal out of U6F and then U6C gates the pulse train from U8A through U10A, U10D and U10C so that the solenoid coil is pulsed rather than driving a DC signal through the coil.

The solenoid driver system drives a solenoid, such as a solenoid in a glue applicator or any like apparatus incorporating a solenoid, and which requires control of the solenoid in response to a signal voltage. The solenoid driver system generates a turn on signal that enables the solenoid, such as that of a glue gun applicator, to energize quickly because of a rapid rise solenoid signal. The solenoid driver stage of two switching transistors and two high voltage fast recovery diodes are connected to a control pulse through the high side optical isolator and the high side buffer, and the low side optical isolator and the low side buffer. The low side circuit includes a trigger circuit and a delay circuit connected to a gate along with a free-running oscillator for periodically energizing the low side drive of the circuit in a mode as long as the input signal is energized. This ensures that the amount of current dissipated in the solenoid coil is small. The current sensing fault logic and shut down logic are provided to prevent damage to the solenoid driver system circuitry or the solenoid coil.

There is an asynchronous initial turn on current pulse of 3 milliseconds to turn on the solenoid coil. Then, there is a free-running current pulse which recharges. The solenoid maintains the solenoid coil energized. The holding current pulse is 3 milliseconds wide every 35 milliseconds. The length of the turn on and hold on pulses and frequency of the hold on pulses is predetermined based on the operational parameters of the solenoid coil.

FIG. 5 illustrates a discussion of the modes of operation of the solenoid driver transistor bridge including the two transistors Q1 and Q2, the two rectifiers CR1 and CR2, and the external solenoid coil. There are four modes of operation. In mode A, no current flows and both transistors are off. In mode B, maximum current flows when Q2 and Q1 are on. In mode C, a free-wheeling current or recirculating current flows through Q2 and CR1. In mode D, the solenoid is turned off rapidly by CR2 and CR1. Table 1 summarizes the four modes of operation.

TABLE 1

(A) No current flows (solenoid is off), Q1 and Q2 off.

(B) Maximum current flows, solenoid being charged by full supply voltage (solenoid is on or being turned on), Q1 and Q2 on.

(C) Solenoid current is free-wheeling via Q2 and CR1 (solenoid is on), Q1 off and Q2 on.

(D) Solenoid is being discharged by full supply voltage via CR2 and CR1 (solenoid is being turned off) Q2 and Q1 off.

Figure 6:
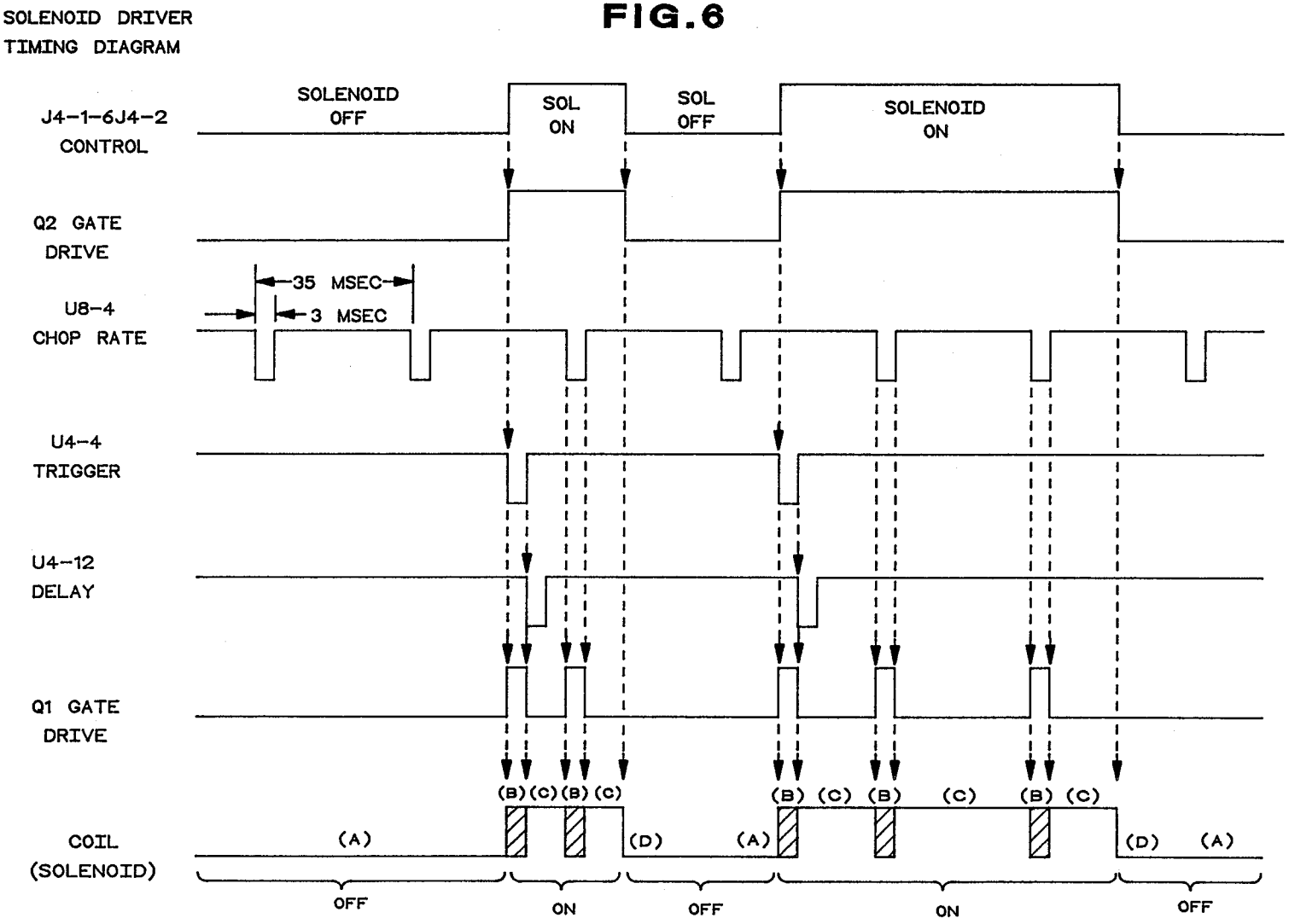

FIG. 6 illustrates the timing diagram for the components as designated on the vertical axis of the diagram over time on the horizontal axis. Reference is further directed to the solenoid coil to FIG. 5 which discloses the modes of operation for modes A, B, C and D with respect to time.

Various modifications can be made to the present invention without departing from the apparent scope hereof.

We claim:

1. Solenoid driver system for rapid turn on of a solenoid coil and low power energization of the solenoid coil after turn on comprising:

a. driving power supply, a high side logic power supply and a low side logic power supply, all connected to an AC input;

b. a high side optical isolator and a low side optical isolator connected to a control pulse input;

c. a high side buffer connected to said high side optical isolator;

d. a solenoid driver connected to said high side buffer and outputting a solenoid power drive signal;

e. a trigger circuit connected between a gate and said low side optical isolator, a delay circuit connected from an output of said trigger circuit to an input of said trigger circuit and a free-running oscillator connected to said gate; and, f. a low side buffer connected between said solenoid driver stage and said gate whereby said solenoid driver system provides a first maximum current flow for solenoid coil turn on and a second minimal current flow for solenoid coil operation.

2. Solenoid driver system for rapid turn on of a solenoid coil with low power energization of the solenoid coil after turn on comprising:

driving power supply, a high side logic power supply and a low side logic power supply, all connected to an AC input;

b. a high side optical isolator and a low side optical isolator connected to a control pulse input;

c. a high side buffer connected to said high side optical isolator;

d. a solenoid driver connected to said high side buffer and outputting a solenoid power drive signal;

e. a trigger means connected between a gate and said low side optical isolator, a delay means connected from an output of said trigger means to an input of said trigger means and a free-running oscillator means connected to said gate; and, f. a low side buffer connected between said solenoid driver stage and shut down logic, said shut down logic connected to said gate whereby said solenoid driver system provides maximum current flow turn on signal for solenoid coil turn on and minimal current flow hold signal for solenoid coil operation.

3. System of claim 2 wherein said solenoid driver stage includes two N channel FET's.

4. System of claim 2 wherein said high side buffer includes a complementary emitter follower stage.

5. System of claim 2 wherein said low side buffer includes a complementary emitter follower stage.

6. System of claim 2 wherein said trigger means comprises a Schmitt trigger circuit.

7. System of claim 2 wherein said delay means comprises a dual monostable.

8. System of claim 2 wherein said free-running oscillator means comprises a multivibrator.

9. System of claim 2 wherein said gate comprises a Schmitt trigger and quad nor gates.

10. System of claim 2 wherein current sensing fault logic comprises a comparator.

11. System of claim 2 wherein said shut down logic comprises a dual flip-flip.

12. System of claim 2 wherein said N channel FET operates in four modes of operation.

13. System of claim 2 wherein said turn on signal is 3 milliseconds.

14. System of claim 2 wherein said hold on signal is 3 milliseconds.

15. System of claim 14 wherein said hold frequency of signals is every 35 milliseconds in frequency.

16. Solenoid driver system for rapid turn on of a solenoid coil in a glue applicator and for subsequent low power energization of the solenoid coil after turn on comprising:

a. driving power supply, a high side logic power supply and a low side logic power supply, all connected to an AC input;

b. a high side optical isolator and a low side optical isolator connected to a control pulse input;

c. a high side buffer connected to said high side optical isolator;

d. a solenoid driver connected to said high side buffer and outputting a solenoid power drive signal;

e. a trigger means connected between a gate and said low side optical isolator, a delay means connected from an output of said trigger means to an input of said trigger means and a free-running oscillator means connected to said gate; and, f. a low side buffer connected between said solenoid driver stage and shut down logic, said shut down logic connected to said gate whereby said solenoid driver system provides maximum current flow signal of 3 milliseconds turn on signal for solenoid coil turn on of the glue applicator and minimal current flow pulse width modulated signal of 3 milliseconds every 35 milliseconds hold signal for solenoid coil operation of the glue applicator.

17. System of claim 16 wherein said solenoid driver includes two N channel FETs, two fast recovery diodes connected to the solenoid coil.

18. System of claim 16 wherein said buffer includes complementary emitter follower stages.

19. System of claim 16 wherein said trigger means is a Schmitt trigger.

20. System of claim 16 wherein said free-wheeling oscillator comprises a multivibrator.

* * * * *